US006102204A

United States Patent [19]

Castleberry

[11] Patent Number: 6,102,204

[45] Date of Patent: Aug. 15, 2000

[54] FLORAL TRANSPORTER

[75] Inventor: Wayne Castleberry, Richmond, Va.

[73] Assignee: Horticultural Technologies, Inc., Richmond, Va.

[21] Appl. No.: 09/132,469

[22] Filed: Aug. 11, 1998

[51] Int. Cl.[7] ..... B65D 85/50

[52] U.S. Cl. ..... 206/423; 206/523; 206/585; 47/65.5

[58] Field of Search ..... 206/3, 423, 523, 206/585, 589, 562, 563, 433; 47/65.5, 84, 66.5

[56] References Cited

U.S. PATENT DOCUMENTS

| | | | |
|---|---|---|---|
| 3,153,500 | 10/1964 | Pachmayr et al. | 206/3 |
| 3,154,209 | 10/1964 | Wilhite et al. | 206/562 |
| 3,191,791 | 6/1965 | Jackson | 206/562 |
| 3,311,231 | 3/1967 | English, Jr. | 206/523 |
| 3,618,750 | 11/1971 | Relner | 206/3 |
| 4,640,418 | 2/1987 | Lowry | 206/499 |
| 4,754,880 | 7/1988 | Tehrani | 206/523 |
| 4,757,894 | 7/1988 | Schreckenstein | 206/3 |
| 4,872,563 | 10/1989 | Warder et al. | 206/523 |
| 5,005,694 | 4/1991 | Davis et al. | 206/3 |
| 5,029,703 | 7/1991 | Dulyea, Sr. | 206/315.3 |
| 5,040,678 | 8/1991 | Lenmark, Sr. et al. | 206/443 |
| 5,222,596 | 6/1993 | Jordan | 206/315.6 |
| 5,390,791 | 2/1995 | Yeager | 206/438 |
| 5,447,233 | 9/1995 | Smith | 206/453 |
| 5,738,216 | 4/1998 | Warner | 206/523 |
| 5,775,513 | 7/1998 | Anthony | 206/315.3 |
| 5,794,773 | 8/1998 | Moyer | 206/523 |
| 5,823,363 | 10/1998 | Cassel | 211/60.1 |
| 5,829,594 | 11/1998 | Warder | 206/459.1 |

*Primary Examiner*—Paul T. Sewell
*Assistant Examiner*—Nhan T. Lam
*Attorney, Agent, or Firm*—John S. Hale; Gipple & Hale

[57] ABSTRACT

A transport container for fragile articles having a substantially rigid base member with a bottom planar surface. A plurality of flexible foamed plastic members having the same overall shape as the base member stacked and secured together forming a container body which is secured to the base member. Each of the flexible foamed plastic members defines a plurality of throughgoing substantially circular cutouts with a tooth assembly for each cutout extending inward toward the center point of each substantially circular cutout. The foamed plastic member cutouts axially aligned with cutouts of an adjacent foamed plastic member to form a stepped bore which can hold various sized articles.

16 Claims, 5 Drawing Sheets

FLORAL TRANSPORTER

FIELD OF THE INVENTION

The present invention relates generally to a container for transporting articles and is specifically directed toward a container for transporting horticultural articles such as floral arrangements.

BACKGROUND OF THE INVENTION

There are a number of major problems encountered in providing for the shipment of cut and live flowers and plants and other articles in that the vases, pots, baskets, and receptacles holding same must be securely held in an upright position during shipment from the florist to the final destination and kept from tilting, tipping over or breaking. Furthermore, multiple shipments of different sized and configured items being made to different locations and transported in the same vehicle must be kept from engaging each other during transit to prevent damage to the plants, flowers and receptacles holding the articles. Since delivery personnel are generally part time or unskilled workers with little to no experience in handling delicate shipments and may have minimal job dedication, there is a need to have shipping containers which can be easily handled by the florist and/or delivery personnel to prevent tipping and breakage of the product. There is also a need to be able to stack product so that maximum space utilization can be obtained in the vehicle.

The prior art discloses several examples of containers used for floral transport. As an example U.S. Pat. No. 5,115,915 is directed toward a shipping container of cardboard which holds a pot in place inside the container. The floral arrangement is placed in a pot filled with a block of foamed potting medium and the flowers are held in the container by a foam block disposed above the medium block. U.S. Pat. No. 4,958,461 is directed toward a floral holder which includes a bucket and a lid which is shaped and dimensioned to removably fit on the bucket. The lid is formed with a number of spaced apart openings communicating with a plurality of sleeves secured to and extending downward from the lid projecting inside the bucket. In U.S. Pat. No. 2,486,932 a flower holder container having a bottom wall and a cylindrical disclosed. The inner surface of the cylindrical side wall of the container is formed with a plurality of peripherally spaced inwardly extending vertical flanges. Each flange is provided with several shoulders which are progressively offset toward the center of the container to form ledges for supporting one or more disc shaped shelves which have notches of a radial depth to seat on specific shoulders of the flanges. The disc shelves can hold flowers or a flower pot in registration with the top of the container.

The present invention solves the above problems in a manner not disclosed in the known prior art.

SUMMARY OF THE INVENTION

The present invention is directed toward a plastic foam container defining a plurality of stepped cavities of decreasing diameter which receive and hold articles in a fixed position. A plurality of teeth or fingers extend from the container body into the cavities.

A need exists for a low cost container that can be easily stored, absorbs impact shock and when used provides a stable platform for the articles which it carries. Institutional or commercial purchasers buy containers in large quantities and typically need to store them in a storage area until needed. Although some attempts have been made to meet this need for a low cost stackable container in the prior art, no present device has had the right combination of cost, compact shipping and storage, simple construction, with an easy loading and handling capability. The container of the present invention solves these problems and provides institutions with a convenient, high quality alternative to the cardboard and wire containers which had previously been available to them.

It is an object of the invention to provide a shipping container which can selectively hold and secure fragile articles having different sizes.

It is another object of the present invention to provide a transport container which absorbs shocks without transmitting the shock force to the article being carried.

It is yet another object of this invention to provide large volume purchasers with a device that is highly compact and one that can be easily stored, stacked and transported.

Yet another object of this invention is to provide a device that can be quickly and easily loaded and unloaded by a single unskilled person without tools or complicated hardware.

In the accompanying drawings, there is shown an illustrative embodiment of the invention from which these and other objectives, novel features and advantages will be readily apparent.

DETAILED DESCRIPTION OF THE PREFERRED EMBODIMENT

The best mode and the preferred embodiment of the novel container transporter apparatus of the present invention is shown generally in FIGS. 1 through 6.

Figure 1:
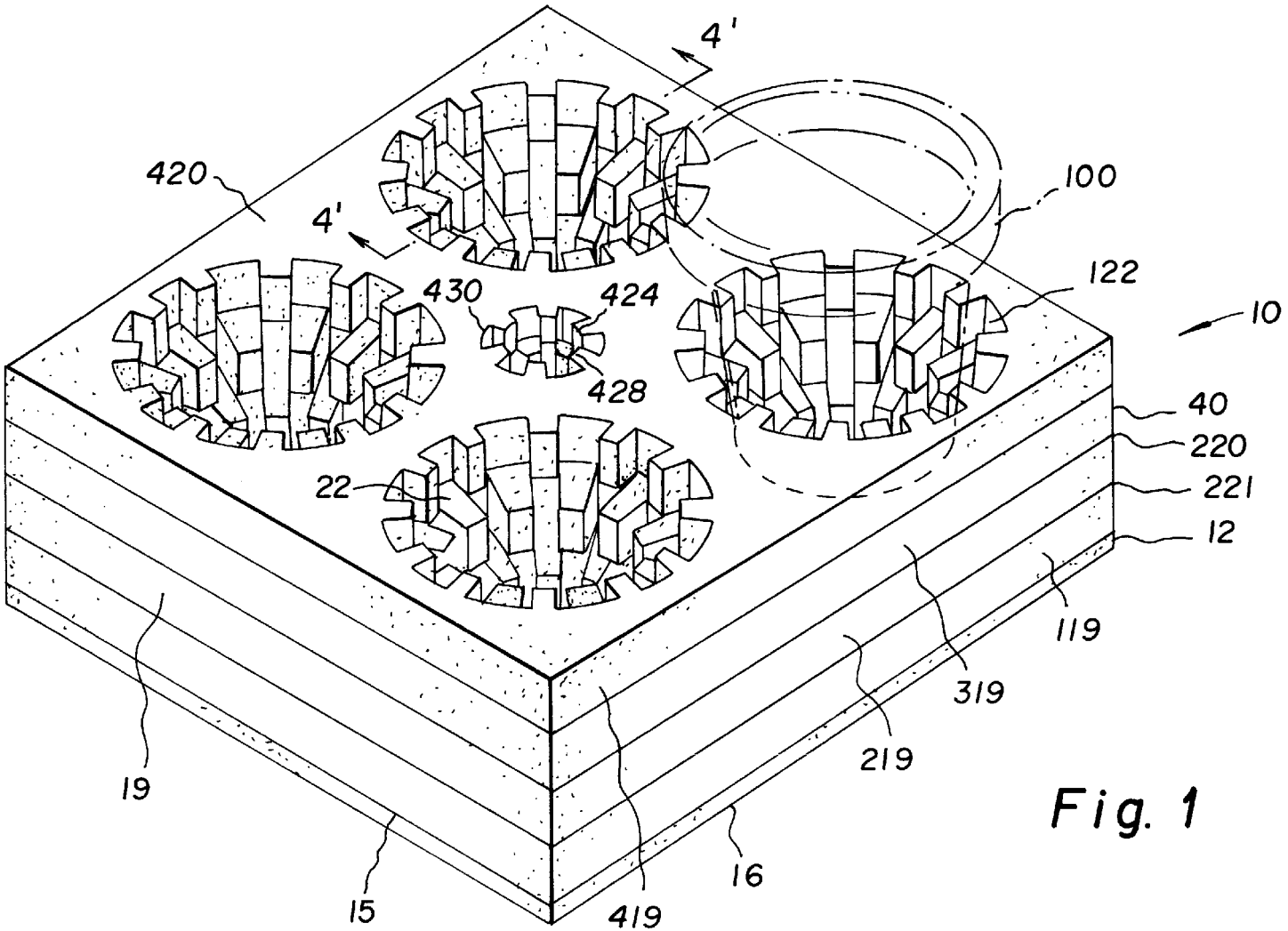
FIG. 1 is a perspective view of the floral transporter container.
Figure 2:
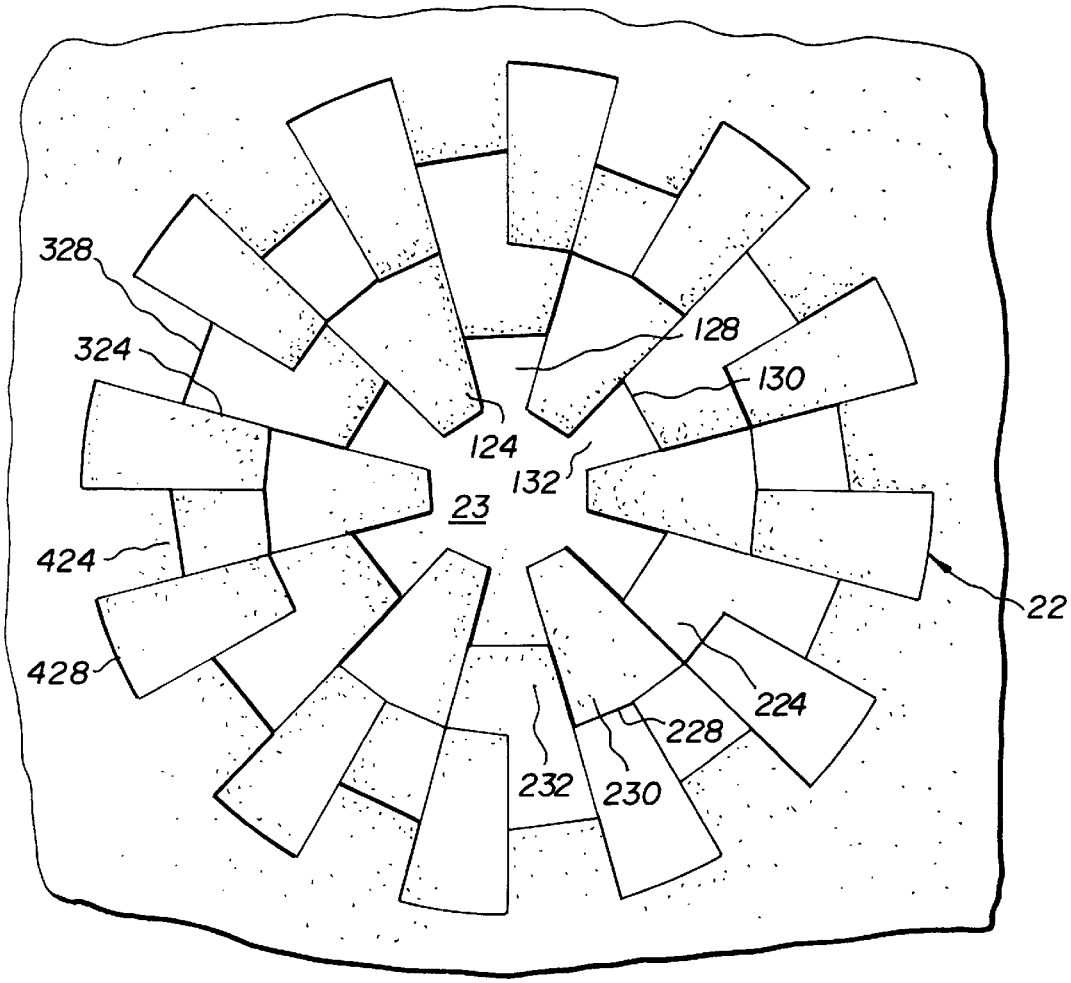
FIG. 2 is a plan view of a cavity of the floral transporter container shown in FIG. 1.
Figure 3:
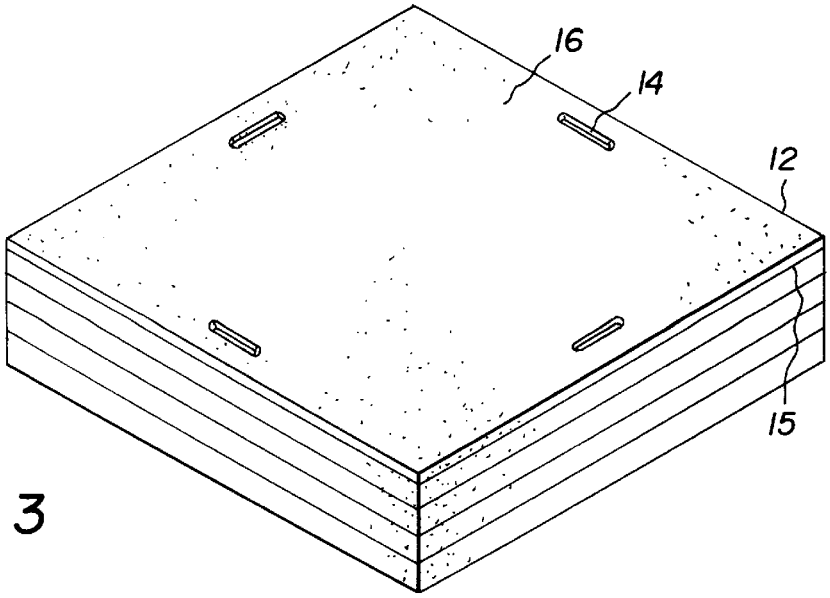
FIG. 3 is a bottom perspective view of the floral transporter container shown in FIG. 1.
Figure 4:
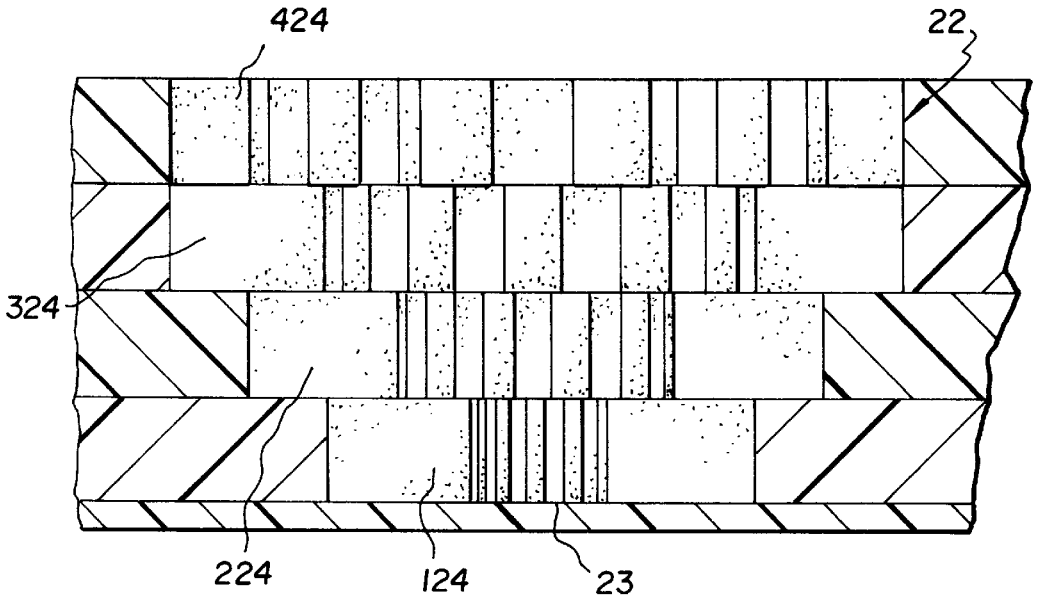
FIG. 4 shows a cross sectional view taken along line 4'—4' of FIG. 1.
Figure 5:
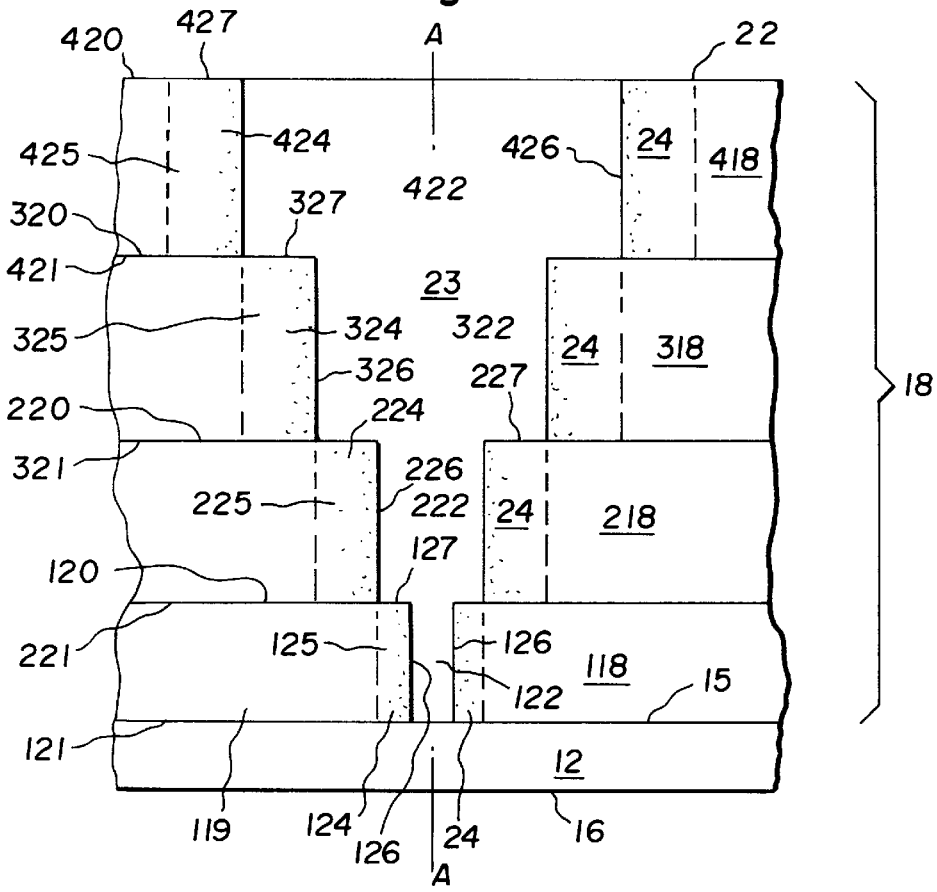
FIG. 5 shows a cross sectional schematic representation of a large corner cavity shown in the cross sectional view taken along line 4'—4' of FIG. 1.
Figure 6:
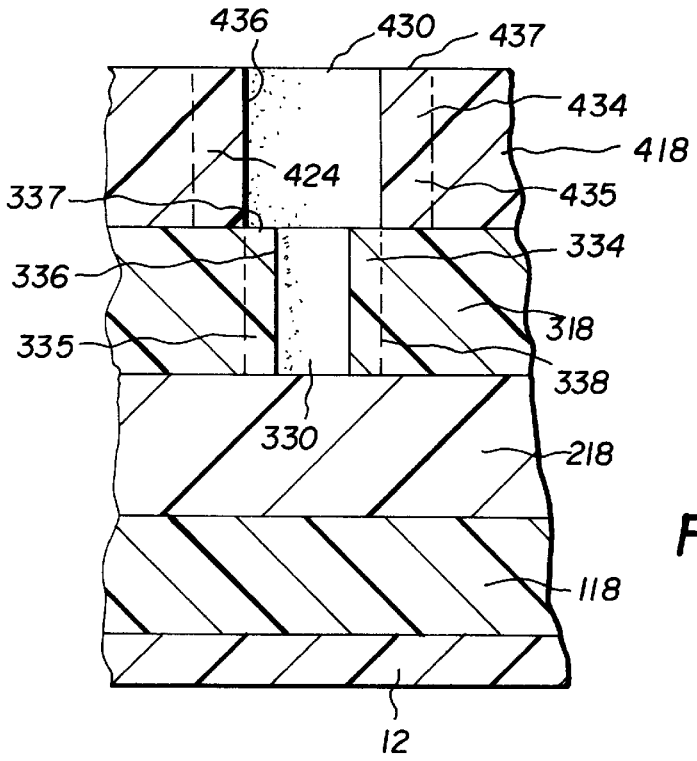
FIG. 6 shows a schematic representation of the smaller center cavity shown in the perspective view of FIG. 1.

FIG. 1 illustrates the container 10 holding a vase 100 containing flowers or another arrangement for delivery. The container 10 which is preferably 24 inches square and 10 inches high is constructed with a rigid non-absorbent polystyrene base member 12 provided with a plurality of hand cutouts 14. Any other non-absorbent high strength plastic or coated corrugated coated cardboard can be readily substituted for the material of the present base member. Polystyrene has been selected because it can absorb shock through the flexible cell structure of the material while retaining rigidity allowing it to maintain shape when handled and lifted. The hand cutouts 14 as seen in FIG. 3 are slot shaped and cut through the plastic base member 12 to allow shipping personnel to hold the container 10 stable while it is being carried and to allow the handler to lift and pull the container across the carpet in a van. The base member 12 as noted is preferably constructed of polystyrene formed in a square 24 inches by 24 inches and 1 inch in thickness having a planar top surface 15, and a planar bottom surface 16 which is provided for seating on the bed of a truck or van in order to form a stable platform which is substantially tip proof. The planar bottom surface 16 has four hand cutouts 14 of an oval shape about 3½ inches in length and ¾ inches in width which extend through the base member 12. A series of container section members 18 preferably formed of an absorbent polyurethane foam with a size of 24 inches by 24 inches and ranging from 2 inches to 2½ inches in thickness are stacked upon each other and secured to each other to form a unified construction. The section members 18 are flexible because of the cell structure of the polyurethane foam which allows the container 10 to absorb shock when struck by other boxes or items in the van or truck without causing the entire container to deform or the shock force to be transmitted to the article being carried therein while still holding the article in a stable condition. In addition the container segment members 18 are constructed of an absorbent material which allows them to absorb spillage of water or to be pre loaded with water or a growing medium to keep plants in a fresh stable condition. Each container member 18 defines a plurality of throughgoing substantially circular cutouts 22 which together define a cylindrical stepped bore or cavity 23. Each of the cutouts 22 has inwardly extending spaced fingers, teeth or ribs 24 directed toward the center of the circular cutout. The circumference of each cutout 22 is located at least one inch from the outside side wall 19 of the container section member 18 to provide shock protection to the article being carried. If desired the outside walls 19 of the container segment members 18 can be covered by a sheet or layer 40 of plastic to provide a sealed container.

The bottom container section member 118 of the stacked members 18 is preferably formed with perpendicular side walls 119, a top planar surface 120 and a bottom planar surface 121. The body defines four throughgoing spaced circular cutouts 122 having a diameter of 3½ inches and six equally spaced teeth 124 positioned around the circumference of the cutouts extending inward toward the center point of the cutout 122. Each tooth 124 has a top planar surface 127, tapered sides 125 and a curved end surface 126 extending inward from the circumference of the cutout about 9/16 of an inch. The teeth 124 define a tapered notch 128 between each pair of teeth. The tapered notches 128 spacing the teeth have a base portion 130 which is wider then the width of the end opening 132 and are substantially mirror images of the teeth.

The adjacent second stacked container section member 218 is formed with perpendicular side walls 219, a top planar surface 220 and a bottom planar surface 221. The body defines four throughgoing spaced circular cutouts 222. Each cutout 222 has a diameter of 5 inches and six spaced teeth 224 extending inward toward the center point of the cutout 222. Each tooth has a top planar surface 227, tapered sides 225 and a curved end surface 226 which extends inward ¾ inch from the circumference of the cutout toward the center axis of the cutout cavity. The teeth 224 define a tapered notch 228 between each pair of teeth with the base of the notch being 1 inch and the top opening of the notch being ¾ inch. The center points of each of the circular cutouts 222 are axially aligned with the center points of each of the circular cutouts 122 of container member 118 and the notches 228 are positioned over the teeth 124 so that the notches and teeth of both container member 118 and container member 218 are staggered when viewed from the top plan view. The top planar surface 127 of teeth 124 which extend inward form a seat for the 4 inch vase.

A third stacked container section member 318 is formed with perpendicular side walls 319, a top planar surface 320 and a bottom planar surface 321. The body defines four throughgoing spaced corner circular cutouts 322 and a smaller central cutout 330. Each corner cutout 322 has a diameter of 7¼ inches and has 12 spaced teeth 324 extending inward toward the center point of the cutout. Each tooth 324 has a top planar surface 327, tapered sides 325 and a curved end surface 326 which extends from the circumference of the cutout inward 1⅛ inches toward the center axis of the cutout. The center cutout 330 has a diameter of 3½ inches and 6 equally spaced teeth 334. Each tooth 334 has a top planar surface 337, tapered sides 335 and a curved end surface 336 which extends inward 9/16 of an inch toward the center axis of the center cutout 330. The teeth 324 of each corner cutout 322 define a tapered notch 328 between each pair of teeth with the base of the notch 328 being ¾ inch and the top opening of the cavity being ⅝ inch. The teeth 334 of the center cutout 330 define a tapered notch 338 between each pair of teeth with the base of the notch 338 being ¾ inch and the top opening of the notch being ⅝ inch. The center axes of each of the circular corner cutouts 320 are axially aligned with the center axis of each of the circular cutouts 120 of container member 118 and the center axis of each of the circular cutouts 220 of container member 218.and the teeth 324 are positioned over the teeth 224 and the notches 228 of the container member 218. The top planar surface 227 of teeth 224 which extend inward form a seat for a funeral pot or a 6 inch basket.

A fourth or top stacked container section member 418 is formed with perpendicular side walls 419, a top planar surface 420 and a bottom planar surface 421. The body of the section member defines four throughgoing spaced corner circular cutouts 422 and a central cutout 430. Each comer cutout 422 has a diameter of 10 inches and 12 equally spaced teeth 424 extending inward toward the center point of the cutout. Each tooth 424 has has a top planar surface 427, tapered sides 425 and a curved end surface 426 which extends from the circumference of the cutout inward 1⅛ inches toward the center axis of the cutout. The center cutout 430 has a diameter of 5 inches and 6 spaced teeth 434 with a top planar surface 437, tapered sides 435 and a curved end surface 436 which extend inward ¾ inch toward the center axis of the center cutout 430. The teeth 424 of each comer cutout 422 define a tapered notch 428 between each pair of teeth with the base of the notch 428 being 1¼ inches and the top opening of the notch being 1 inch. The teeth 434 of the center cutout 430 define a tapered notch 438 between each pair of teeth with the base of the notch 438 being 1¼ inches and the top opening of the notch 438 being 1 inch. The center points of each of the circular corner cutouts 422 are axially aligned with the center points of each of the circular corner cutout 122 of container member 118, the center points of each of the circular cutouts 222 of container member 218, the center points of each of the circular cutouts 322 of container member 318. The teeth 424 are positioned over the notches 328 of the container member 318. The center axis of center cutout 330 is aligned with the center axis of center cutout 430 and the teeth 434 are positioned over the notches 338 of the container member 318. The top planar surface 327 of teeth 324 which extend inward for a seat for a large oval base or a 8 inch basket. The top planar surface 427 of teeth 424 and the top planar surface 437 of teeth 434 are planar with the top surface of container section member 418.

Figure 7:
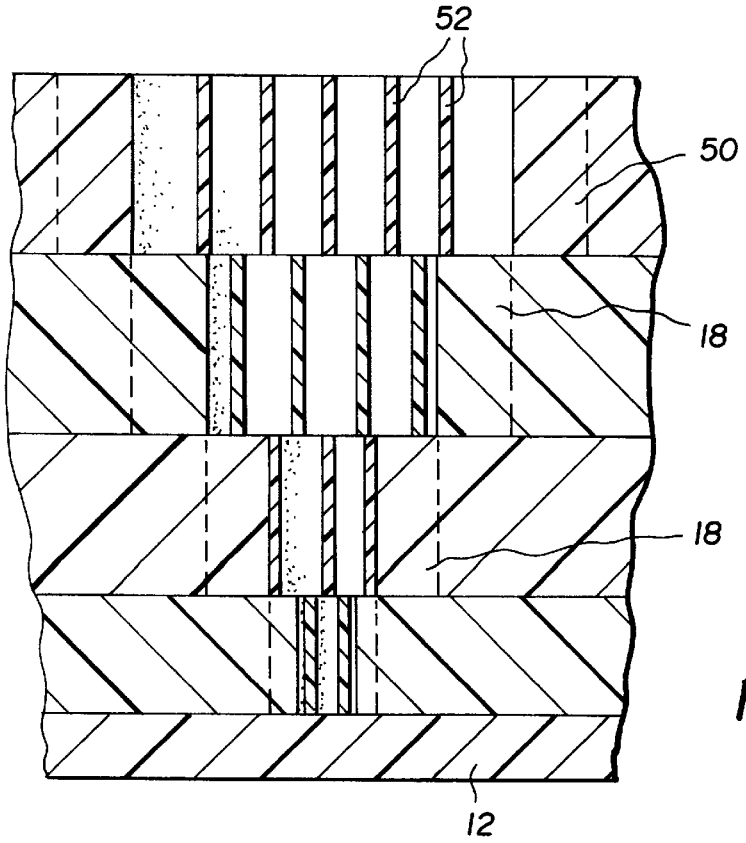
FIG. 7 is a schematic representation of a cavity of the floral transporter container with a slotted ring configuration replacing the tooth and notch configuration shown in FIG. 2.

It is also envisioned that the teeth or fingers of each container member can be replaced with a slotted ring configuration as is shown in FIG. 7. In this configuration the ring body 50 is provided with a plurality of slits 52 to provide flexibility. While the preferred embodiment has circular cutouts 14, other geometrically arranged cutouts as for example, triangular cutouts and rectangular cutouts could be used.

In practice the top corner cutout 422 of the top layer of the container or fourth section member 418 forms a first step. The teeth 424 are designed to hold a large oval vase or an 8 inch basket. The planar surfaces of teeth 324 of the third section member form the seat for the vase or the 8 inch basket. The next layer corner cutout 322 forms a second step which is designed to hold a funeral pot or a 6 inch basket with teeth 324. The planar surfaces of teeth 224 of the section member 218 form the seat for the funeral pot. The comer cutout 222 forms a third step which is designed to hold a 4 inch vase within teeth 224 seated on the planar surfaces 127 of teeth 124. The bottom layer corner cutout 122 forms a fourth step which is designed to hold a bud vase with its teeth 124, The bud vase is seated on the top surface of base member 12.

Figure 8:
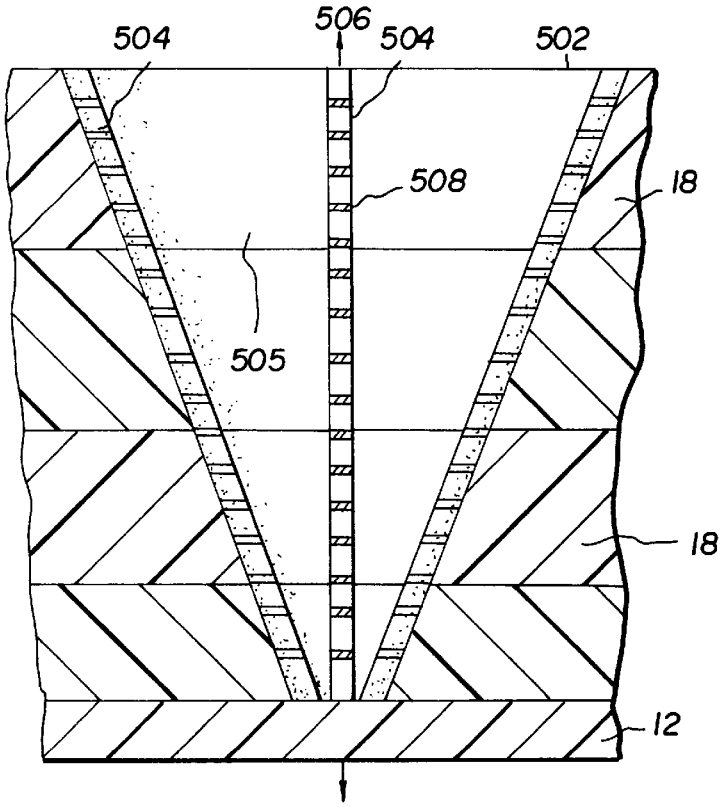
FIG. 8 is a schematic representation of a cavity of an alternative conical cavity and longitudinal rib embodiment of the invention.
Figure 9:
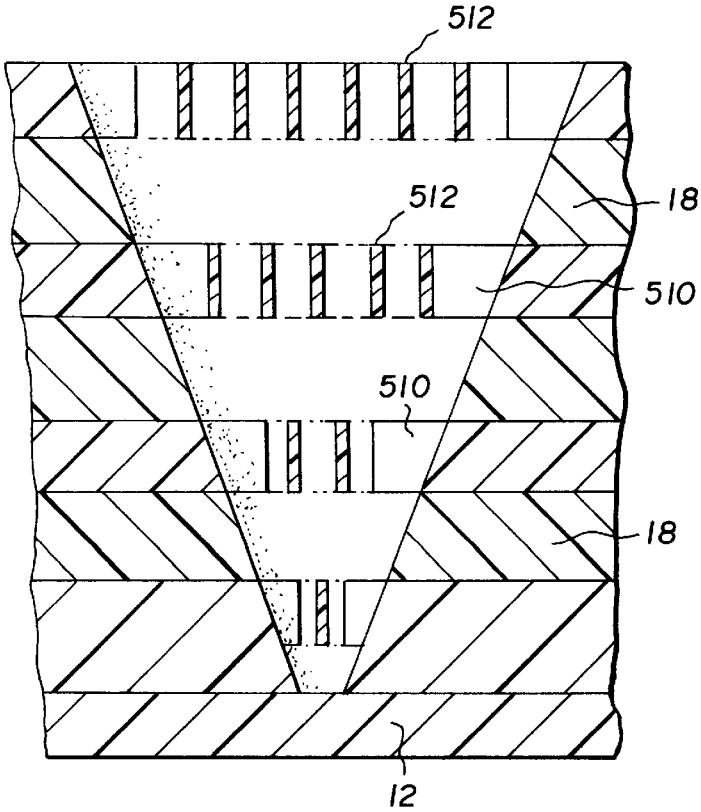
FIG. 9 is a schematic representation of a cavity of another alternative conical cavity and ring embodiment of the invention.

An alternative embodiment 500 is shown in FIG. 8. In this embodiment the container cavity is a conical cavity 502 with a plurality of linear ribs 504 running along the inner wall 505 of the container extending inward toward the center axis 506 of the conical cavity 502. The ribs 504 are provided with a plurality of slits 508 running transverse the ribs 504 longitudinal axis. Each rib has tapering side walls 505 and an end wall 507. Alternately the rib 504 can be replaced with a plurality of parallel rings 510 which can be spaced by slits 512 or notches 514 to form a series of steps within the conical cavity allowing easy seating and removal. It is understood that the term conical cavity also includes frustrum or truncated cone shapes.

The principles, preferred embodiments and modes of operation of the present invention have been described in the foregoing specification. However, the invention should not be construed as limited to the particular embodiments which have been described above. Instead, the embodiments described here should be regarded as illustrative rather than restrictive. Variations and changes may be made by others without departing from the scope of the present invention as defined by the following claims:

What I claim is:

1. A transport container for holding varying size articles, comprising:

a rigid base portion and a foamed plastic flexible container body portion secured to said base portion, said body portion having a top surface which is planar and a base portion with a bottom planar surface, and comprising a plurality of stacked section members, each section member defining a plurality of throughgoing cutouts of different sizes which are axially aligned with the cutouts of an adjacent container member to form a stepped cavity adapted to receive and hold different sized articles in a fixed position.

2. A transport container as claimed in claim 1 wherein said cutouts are circular with each section member defining a cutout with a smaller diameter than the cutout of the section member stacked above it and said body portion defines a plurality of spaced teeth which extend inward toward the center of said circular cutout.

3. A transport container as claimed in claim 1 wherein said rigid base portion defines slots forming handle grips for carrying said transport container.

4. A transport container as claimed in claim 1 wherein said body portion has stacked section members which define at least four corner cavities and at least one center cavity.

5. A transport container as claimed in claim 1 wherein said body portion includes a plurality of cavities, each of which has at least two cutouts which have different diameters when measured across the same positional plane in each of the section members.

6. A transport container, comprising: a rigid base section which allows the container to be carried, a body secured to said base section defining a plurality of circular bores, each of said bores defining step portions, with the diameter of each step portion decreasing from the diameter of the step portion positioned above it, each step portion including teeth means extending from said body inwardly toward the center of said bore, said teeth means comprising a plurality of spaced teeth members, each of said teeth members being tapered with a base which is wider then its distal end, said distal end defining a curved outer end surface.

7. A transport container as claimed in claim 6 wherein said teeth members are spaced by notched cutouts.

8. A transport container as claimed in claim 6 wherein body comprises a plurality of stacked secured section members, each section member being constructed of polyurethane foam and defining a plurality of throughgoing bores that are axially aligned when stacked upon each other.

9. A transport container as claimed in claim 8 wherein there are four stacked secured section members, each of said section members defining a plurality of cutouts which are axially aligned when the section members are stacked with each cutout having a diameter less than the cutout of the stacked member positioned above it.

10. A transport container as claimed in claim 8 wherein said section members are constructed of a foamed plastic.

11. A transport container as claimed in claim 2 wherein said foamed plastic members are rectangular in shape.

12. A transport container assembly, comprising:

a rigid base member with a bottom planar surface, a plurality of flexible foamed plastic members having the same overall shape as the base member stacked on said base member and secured together forming a container body which is secured to said base member, each of said flexible foamed plastic members defining a plurality of throughgoing cutouts with a tooth assembly for each cutout extending inward toward the center point of each cutout, said foamed plastic member cutouts being axially aligned with cutouts of an adjacent foamed plastic member to form a stepped bore, wherein each tooth of said tooth assembly is tapered with the base being wider than the distal end.

13. A transport container assembly as claimed in claim 12 wherein each cutout is circular and the number of teeth in said tooth assembly range from 6 to 12 teeth.

14. A transport container assembly as claimed in claim 12 wherein said container assembly is surrounded by an impervious layer of plastic.

15. A transport container assembly as claimed in claim 12 wherein said base member has a planar bottom surface and defines a plurality of throughgoing slots forming handle grips.

16. A transport container for holding varying size articles, comprising:

a rigid base portion, a foamed plastic flexible container body portion mounted on and secured to said rigid base portion, said body portion comprises a plurality of stacked secured flexible section members, each section member defining a plurality of throughgoing cutouts of different sizes which are axially aligned with the cutouts of an adjacent section member to form a plurality of stepped cavities adapted to receive and hold different sized articles in a fixed position to provide shock protection for said articles when mounted in said cavities, said body portion having a top surface which is planar and said base portion being provided with a bottom planar surface.

* * * * *